United States Patent [19]

Fischer

[11] Patent Number: 4,530,285

[45] Date of Patent: Jul. 23, 1985

[54] PRINTING MACHINE INKING MONITORING SYSTEM

[75] Inventor: Hermann Fischer, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 541,164

[22] Filed: Oct. 12, 1983

[30] Foreign Application Priority Data

Oct. 21, 1982 [DE] Fed. Rep. of Germany ..... 3238912

[51] Int. Cl.[3] ..... B41F 31/04; B41L 27/06

[52] U.S. Cl. ..... 101/365; 101/DIG. 24; 101/DIG. 26

[58] Field of Search ..... 101/365, 350, 148, 181, 101/DIG. 24, DIG. 26

[56] References Cited

U.S. PATENT DOCUMENTS

| | | | |
|---|---|---|---|
| 3,234,871 | 2/1966 | Ostwald | 101/148 |
| 3,756,725 | 9/1973 | Manring | 356/425 |
| 3,916,789 | 11/1975 | Watts | 101/148 |
| 4,440,084 | 4/1984 | Pozin | 101/365 |

FOREIGN PATENT DOCUMENTS

| | | | |
|---|---|---|---|
| 1519883 | 2/1967 | France | 101/365 |

*Primary Examiner*—J. Reed Fisher

*Attorney, Agent, or Firm*—Frishauf, Holtz, Goodman & Woodward

[57] ABSTRACT

To sense the ink density, in zones, transversely of a plate cylinder while avoiding possible erroneous determination due to transport of contaminants such paper dust or fluff, from the blanket cylinder to the plate cylinder, the attachment groove for the blanket (4) of the blanket cylinder (2) is made wider than the attachment groove (10) for the plate (3) of the plate cylinder (1), to leave a transverse strip (A) extending across the plate, on which sensing fields (12) are applied, for example by printing-on; the sensing fields, located in adjacent zones (Z) will be inked by the inking system (25) of the printing machine and, since out of contact with the blanket, will remain uncontaminated. A densitometer (13) sensing the inking density in the respective fields is translated across the printing cylinder, and sensed values are associated with the measuring fields (12), for example by determining rotation (n(sync)), permitting control of adjustment screws of a doctor blade (24) by suitable servo motors (23).

10 Claims, 2 Drawing Figures n (sync)
18
1
21
17
2
A
12
12
13
14
15
16
Z
18
19
n (sync)
20
22
23
24
25
26

PRINTING MACHINE INKING MONITORING SYSTEM

The present invention relates to printing machines, and more particularly to rotary offset printing machines in which the inking of the plate cylinder can be controlled with respect to circumferential zones located adjacent each other.

BACKGROUND

It has previously been proposed to monitor the inking of the plate cylinder of printing machines by checking the distribution of inking in circumferential zones, located adjacent each other, using a densitometric apparatus (see the referenced French Pat. No. 1,519,883). The densitometric measuring apparatus checks the ink density during rotation of the plate cylinder with respect to the entire circumference thereof. It has been found that the measured results do not necessarily correspond to the actual inking. The blanket cylinder, in operation, will pick up dust, fluff, or other contaminants from the printing substrate, typically paper. The contaminants are transferred in the course of operation from the blanket cylinder to the plate cylinder, and the ink measuring apparatus will then respond not only to the actual inking, but to the ink as contaminated. The output derived from the densitometers, then, could be erroneous, and non-representative of the actual inking.

THE INVENTION

It is an object to improve densitometric measurement of inking of plate cylinders by contactless measuring means which is free from errors due to contamination of the plate cylinder in operation.

Briefly, the attachment groove of the printing plate cylinder is made narrower—in circumferential direction—than the attachment groove of the blanket cylinder, so that a narrow transverse strip or region will be formed on the plate cylinder which will not come into engagement with the blanket cylinder. Inking rollers will, however, be in circumferential engagement with the narrow strip as well as with the remainder of the plate cylinder. Densitometric measurement of ink being applied to the plate cylinder is carried out by measuring the inking, in transverse zones, of that narrow strip. This can easily be done by synchronizing the measurement or scanning instant with rotation of the cylinders, and making the measurement when the strip is under the measuring sensor.

In accordance with a feature of the invention, the measuring sensor is located on a spindle and is moved transversely with respect to the plate cylinder during the time that the plate cylinder rotates, measuring being effected at the time when the sensor is in sensing position with respect to the narrow sensing strip. The output from the sensor can then be used to control inking of the respective zones, for example by re-adjustment of doctor blade screws through a servo motor system, as well known.

The system has the advantage that it can readily be constructed to be non-contacting; control elements are simple and can be assembled from commercially available elements. Above all, however, the output signals derived from the densitometric sensor will be truly representative of inking of the respective zones on the plate cylinder, without danger of contamination by dust, fluff, or other contaminants transferred to the plate cylinder in the region where the plate cylinder and the blanket cylinder are in engagement.

DRAWINGS

FIG. 1 is a schematic side view of the regions of the clamping grooves of a plate cylinder and a blanket cylinder; and FIG. 2 is a schematic part-structural, part-connecting diagram of the measuring system.

DETAILED DESCRIPTION

Figure 1:
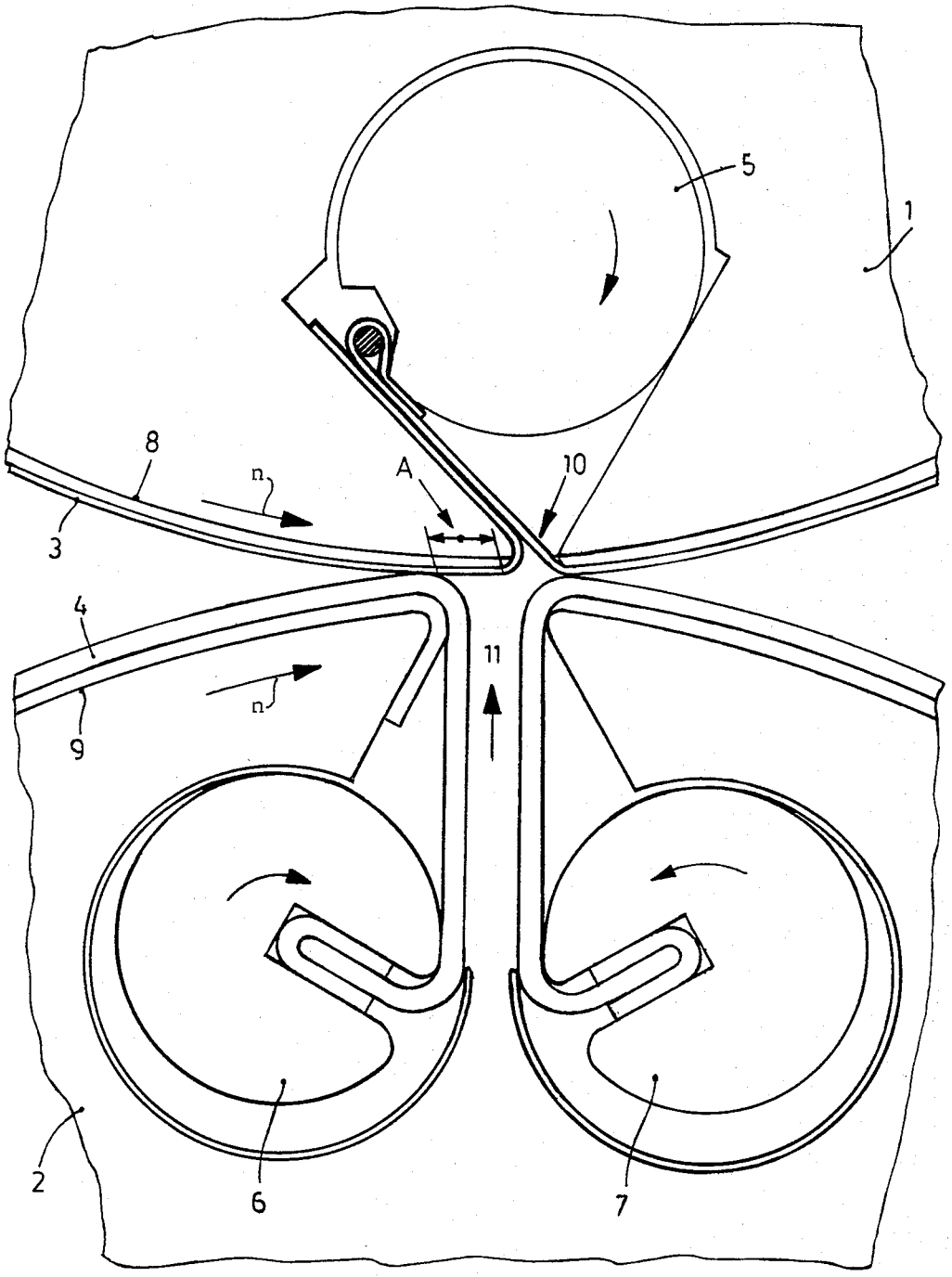

A plate cylinder 1 (FIG. 1) is positioned for engagement with the blanket cylinder 2. The plate cylinder carries, in customary manner, a plate 3 stretched over a substrate 8. The blanket cylinder carries, likewise, in customary manner, a rubber blanket 4 positioned over an underlay 9. The plate as well as the rubber blanket are clamped in position by customary clamping arrangements shown at 5 for the plate, and by clamping spindles 6, 7 for the blanket cylinder. Any other clamping arrangement may be used. The clamping arrangements for the plate and the rubber cylinder, thus, can be standard and in accordance with well known constructions.

In accordance with a feature of the invention, the attachment grooves 10, 11 for the plate cylinder and the blanket cylinder, respectively, are of different widths. The groove 10 for the plate cylinder 1 is substantially narrower than the groove 11 of the blanket cylinder—see FIG. 1. When the terminal ends of the cylinders 1, 2 are placed in alignment, the initial position of the plate cylinder 1 will have a region A of advance with respect to that of the blanket cylinder. The plate 3, thus, will have a zone or strip within the region A which will be inked, but which is not touched by the blanket cylinder 4, so that no ink can be applied to the blanket cylinder in that region. As referred to above, this has the advantage that the region A will not receive any feedback of ink from the blanket cylinder, and hence will not receive any contamination which is applied to the blanket cylinder, for example paper, fluff or the like, due to the contact of the blanket cylinder with the printing substrate.

In accordance with a feature of the invention, a measuring field 12 (FIG. 2) is generated in the strip A with respect to each zone Z. This measuring field is copied on or defined or provided on the plate cylinder 1. The plate cylinder 1, of course, in accordance with standard rotary offset printing machine construction, is in continuous engagement with at least one ink transfer or application roller (not shown) which provides continuous ink transfer to the plate 3. The ink transfer or application cylinder or roller has a continuous surface.

Figure 2:
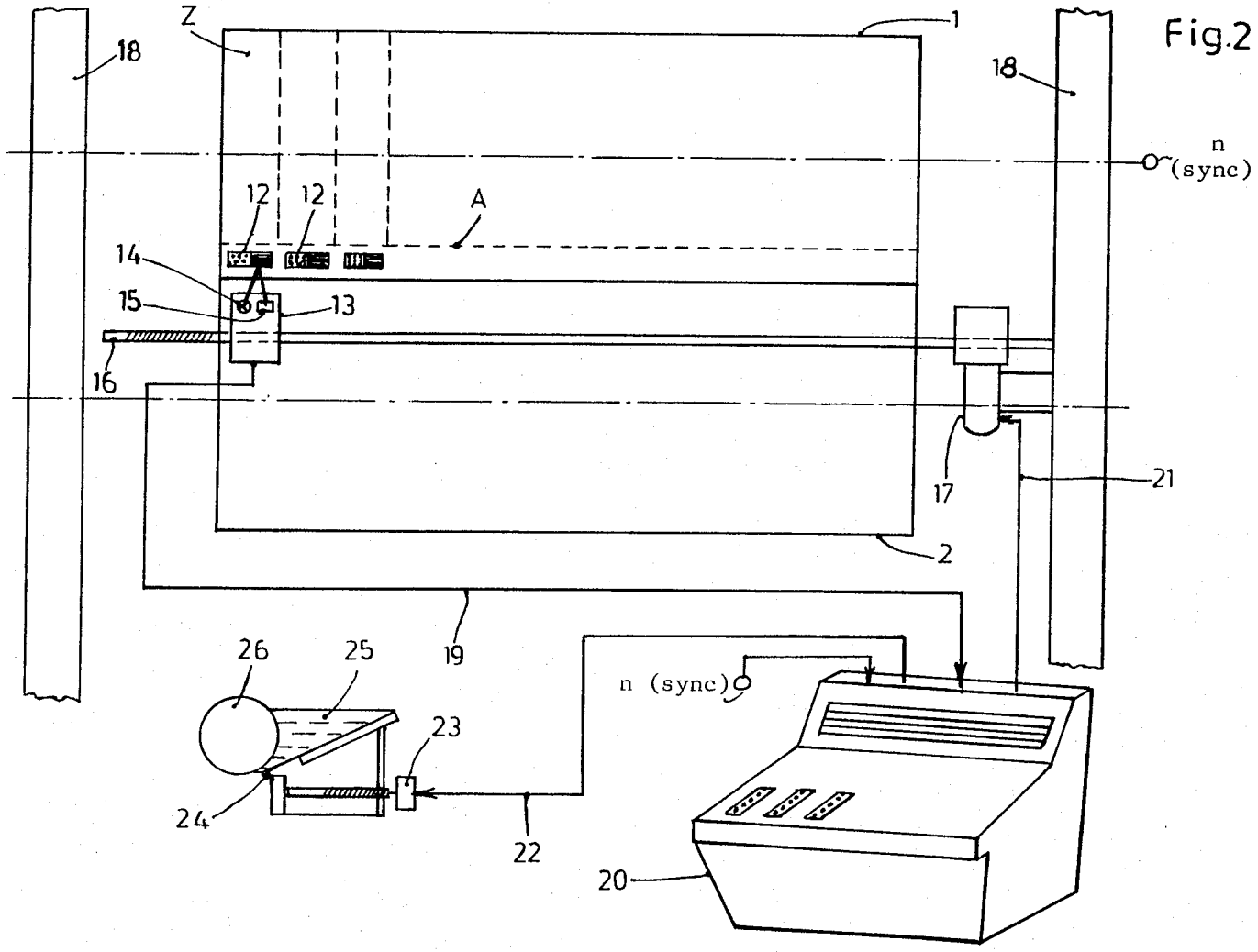

A densitometer 13, of well known and standard construction, scans the respective zones during operation of the machine. Rotation of the cylinders is schematically indicated by the arrows n (FIG. 1), and a rotation signal n(sync) can be derived from one or both of the cylinders in well known manner, for example by sensing each time a marker element passes a stationary pick-up. The signal n(sync), namely the rotation synchronizing signal, is applied to a control unit 20. The densitometer, for example, includes a source of radiation, such as a light source, and a reflective-type pick-up sensor 15, for example a photosensitive diode, transistor or the like. The densitometer 13 is located on a rotating, threaded spindle 16. Threaded spindle 16 is driven by an electric motor, preferably a stepping motor 17. Rotation of the spindle 16 is so synchronized with the rotation of the cylinder 1 by the rotation synchronizing signal n(sync) that the measuring head 13 is transported, in steps, from ink zone Z to an adjacent ink zone as the cylinder rotates. Thus, upon each rotation or multiple thereof, the densitometer 13 will sense respectively adjacent measuring fields 12 as the densiometer 13 translates axially with respect to the cylinder 1. The output from the densitometer is applied over control line 19 to the control unit 20. For example, let it be assumed that the densitometer 13 senses the measuring field 12 in the first zone Z. During one revolution of the plate cylinder 1, the densitometer 13 is moved, due to energization of the motor 17, by one step towards the right, to the second zone Z, for scanning of the second zone at the begining of the subsequent revolution of the plate cylinder. FIG. 2 illustrates, in schematic arrangement, the plate cylinder 1, the blanket cylinder 2, two side walls 18, the threaded spindle 16, and the motor 17, secured for example to a side wall 18. The densitometer 13 has an internal threaded spindle nut to move laterally, upon rotation of the spindle 16.

Operation: During rotation of the cylinders 1, 2, and application of ink to the plate cylinder 1 by a suitable ink application or ink transport roller (not shown), the plate 1 as well as the measuring fields 12 will be inked. The distribution of the ink, axially, is not necessarily uniform; it may require different ink density, depending on the subject matter to be taken off the plate in the respective zones. Since the region A is not contacted by the rubber blanket 4 on the blanket cylinder 2, no ink will be transferred from the measuring fields 12 to the blanket 4. Rather, after some initial start-up revolutions, ink, by splitting, will be transferred back from the region A, that is, from the measuring fields 12 to the ink application rollers which, further, will also provide for re-inking thereof. After run-in, a balance or equilibrium will establish itself. The measuring fields 12, thus, within the region A, will receive inking which is representative of the inking of the subject matter beyond the region A in the respective zones Z. It is this inking in the measuring fields, in the respective zones Z, which is scanned by the densitometer sensor 13 when the respective measuring fields 12 in the zone A pass the densitometer.

The scanned or sensed values, derived from the densitometer 13, are applied over connecting line 19 to the control unit 20 which, for example, may be in the form of a supervisory control element. The control unit 20 additionally receives position or rotation signals n(sync) to provide appropriate control signals to the motor 17 to move the densitometer 13 from one zone to the next, in the drawing, FIG. 2, towards the right. When the final end position is reached, the densitometer 13 can be returned by a rapid-return movement or can scan backwardly, as desired.

The sensed measured values derived from the densitometer 13, and for example sampled at the time the measuring field 12 is opposite the sensor 13, are then used to control respective servo motors 23 via lines 22 to adjust the inking of zones of an ink ductor roller 26 operating in the ink trough of an inker 25, by adjusting the position of a doctor blade 24 in zone arrangement. Servo motor control of doctor blades in printing machines is well known, and the particular control arrangement to adjust the position of the doctor blades, in zones, can be of any suitable standard and well known construction.

The sensor 13, or a supervisory program entered into the control unit 20, can be arranged to provide for predetermined inking within predetermined zones. For example, the sensor 13 in a specific zone Z may determine that the inking is too intense with respect to the commanded inking. A signal will be derived from the control unit 20, applied to the servo motor controlling the doctor blade 24 in the respective zone, to narrow the nip between the doctor blade 24 and the roller 26, so that the quantity of ink being applied to the roller 26 is reduced, until the appropriate inking is achieved as sensed by the sensor 13 during subsequent revolutions of the cylinder 18. The association of the respective signals n(sync) with the sensor signals from sensor 13 and the output signals over line 22 to the respective motors can be controlled by any well known and standard stepping switching system which can be mechanical, with relays, or electronic, under control of commercially available microprocessor chips in accordance with standard and well-known control technology.

Various changes and modifications may be made within the scope of the inventive concept.

I claim:

1. Inking monitoring and control system for a rotary offset printing machine, having a plate cylinder (1);

a printing plate (3) attached to the plate cylinder;

a plate attachment groove (10) located in the cylinder for attachment of the printing plate to the plate cylinder;

a rubber blanket cylinder (2);

a rubber blanket attachment groove (11) formed in the blanket cylinder;

a rubber blanket (4) attached to the rubber blanket cylinder in the groove (11) and engageable with the printing plate (3) on the plate cylinder;

and means (13) for sensing ink density of the plate cylinder, in zones (Z) extending circumferentially about the plate cylinder and located axially adjacent each other, wherein, in accordance with the invention, the blanket attachment groove (11)—in circumferential direction with respect to the blanket cylinder—is wider than the plate attachment groove (10) to leave a transverse end strip (A) of the plate (3) out of engagement with the blanket (4);

the region of the zones falling within said strip (A) define ink control fields (12), located on the plate (3) in the end strip (A) thereof and not engaged by the blanket cylinder due to the wider blanket groove, and the ink density sensing means (13) are positioned for sensing the respective ink density in the respective ink control field (12) of the respective zones during operation of the machine and consequent rotation of the plate cylinder.

2. System according to claim 1, wherein the means for sensing ink density (13) comprises at least one densitometer (13, 14, 15).

3. System according to claim 1, further comprising a transport spindle (16) located parallel to the plate cylinder;

and wherein the means (13) for sensing ink density are located on the transport spindle for transverse movement with respect to the plate cylinder and scanning of the respective ink control fields of the zones (Z).

4. System according to claim 3, further comprising a motor (17) secured to a frame (18) of the printing machine for rotating the spindle (16).

5. System according to claim 1, further comprising control means (20) receiving signals representative of rotation of the plate cylinder and, signals derived from the ink density sensing means (13, 14, 15) and for providing positioning output signals to the ink density sensing means for measuring ink density when the respective control fields of the respective zones are positioned in sensing relationship with respect to the ink density sensing means.

6. System according to claim 4, further comprising control means (20) receiving signals representative of rotation of the plate cylinder, signals derived from the ink density sensing means (13, 14, 15) and providing positioning output signals to the motor driving the spindle (16) for the ink density sensing means for measuring ink density when the respective control fields of the respective zones are positioned in sensing relationship with respect to the ink density sensing means.

7. The system of claim 5, in combination with an inker (25) having an ink duct roller (26);

a doctor blade (24);

and means (23) for adjusting the position of the doctor blade (24) with respect to the ink duct roller, in selected zones extending axially with respect to the doctor blade (24), wherein said doctor blade adjustment means (23) are connected to and controlled by said control means (20) to adjust the doctor blade to provide a predetermined ink density in the respective sensing fields (12).

8. The system of claim 6, in combination with an inker (25) having an ink duct roller (26);

a doctor blade (24);

and means (23) for adjusting the position of the doctor blade (24) with respect to the ink duct roller, in selected zones extending axially with respect to the doctor blade (24), connected to and controlled by the control means (20).

9. Inking monitoring and control system for a rotary offset printing machine, having a plate cylinder (1);

a printing plate (3) attached to the plate cylinder;

a plate attachment groove (10) located in the cylinder for attachment of the printing plate to the plate cylinder;

a rubber blanket cylinder (2);

a rubber blanket attachment groove (11) formed in the blanket cylinder;

a rubber blanket (4) attached to the rubber blanket cylinder in the groove (11) and engageable with the printing plate (3) on the plate cylinder;

and means (13) for sensing ink density of the plate cylinder, in zones (Z) extending circumferentially about the plate cylinder and located axially adjacent each other, wherein, in accordance with the invention, the blanket attachment groove (11)—in circumferential direction with respect to the blanket cylinder—is wider than the plate attachment groove (10) to leave a transverse end strip (A) of the plate (3) out of engagement with the blanket (4);

the region of the zones falling within said strip (A) define ink control fields (12), located on the plate (3) in the end strip (A) thereof and not engaged by the blanket cylinder due to the wider blanket groove, and means for selectively, sequentially positioning the ink density sensing means over respective ink control fields (12) in the respective zones, for sensing of ink density in the respective ink control fields of the respective zones during operation of the machine and upon rotation of the plate cylinder by the ink density sensing means.

10. The system of claim 9 in combination with an inker (25) having an ink duct roller (26);

a doctor blade (24);

and means (23) for adjusting the position of the doctor blade with respect to the ink duct roller, in selected zones extended axially with respect to the doctor blade (24);

and wherein said doctor blade adjustment means (23) are connected and controlled by the output signals from said ink density sensing means to adjust the doctor blade in the selected zones with respect to control signals derived from the sensing means in respectively similar circumferentially extending zones (A) of the plate cylinder.

* * * * *